United States Patent [19]

Fabbri et al.

[11] Patent Number: 4,552,159

[45] Date of Patent: Nov. 12, 1985

[54] APPARATUS FOR TREATING HAIR

[76] Inventors: Vittorio E. Fabbri, 8411 Crystal Springs Rd., Woodstock, Ill. 60098; Jackie D. Bell, 1596 Bedlington Dr., Barrington, Ill. 60010

[21] Appl. No.: 506,441

[22] Filed: Jun. 21, 1983

[51] Int. Cl.[4] ..... A45D 7/00; A45D 8/00

[52] U.S. Cl. ..... 132/9; 132/45 R; 132/7

[58] Field of Search ..... 132/1 R, 7, 9, 45 R, 132/45 A, 48 R, 48 A

[56] References Cited

U.S. PATENT DOCUMENTS

| | | | |
|---|---|---|---|
| 3,068,874 | 12/1962 | Rapisarda | 132/9 |
| 3,198,196 | 8/1965 | Sawin | 132/9 |
| 3,662,767 | 5/1972 | Murtha | 132/9 |
| 3,692,032 | 9/1972 | Regas | 132/9 |
| 3,800,811 | 4/1974 | Esposto | 132/9 |
| 3,923,068 | 12/1975 | Gilman | 132/9 |
| 3,941,613 | 3/1976 | Nicoletti | 132/9 |
| 3,952,726 | 4/1976 | Henning et al. | 128/DIG. 25 |
| 4,144,897 | 3/1979 | Mosz | 132/9 |
| 4,196,741 | 8/1980 | Minghenelli | 132/9 |
| 4,224,954 | 9/1980 | Stahl | 132/7 |
| 4,338,937 | 7/1982 | Lerman | 128/DIG. 25 |
| 4,402,314 | 9/1983 | Goode | 128/342 |

*Primary Examiner*—Gene Mancene
*Assistant Examiner*—Carolyn Harrison
*Attorney, Agent, or Firm*—Welsh & Katz, Ltd.

[57] ABSTRACT

A hair treating device includes a pliable liquid impermeable sheet adapted to be placed in underlying relation to selected strands of hair during application of a hair treating substance to the selected strands and is of sufficient lateral width to extend laterally outwardly from opposite sides of the selected strands. In one embodiment, the pliable sheet is of sufficient length to enable it to be folded upon itself and substantially overlie the selected hair strands. The pliable sheet has discrete domains of alternating magnetic polarity defined therein operative to releasably maintain the folded layers in juxtaposed relation through magnetic attraction therebetween and establish a liquid seal about substantially the full periphery of the treated hair strands. In another embodiment, one or more separate pliable sheets of similar material are adapted to be selectively placed in overlying relation to a primary pliable sheet underlying the hair strands, the sheets being magnetically affixed with the treated hair strands therebetween. A liquid absorbing member may be carried on at least one of the juxtaposed sheets to absorb seepage of the hair treating substance.

7 Claims, 5 Drawing Figures

14b
18
14c
14a
12
14
14e
10
14d 26
14c
14b
14a
14
14e
16
16
14d 12
28
10
26
14
14a
14f
20

16
22a
14f
14e
14e
16
22b
14f 12
42
38
40
36
34

APPARATUS FOR TREATING HAIR

BACKGROUND OF THE INVENTION

The present invention relates generally to devices for use in treating hair, and more particularly to a novel device for use in treating selected strands of hair during application of a hair treating substance thereto such as in coloring or tinting hair.

It is a common practice in the treatment of hair, and particularly women's hair, to selectively color or tint selected strands of hair while separated and isolated from the remaining hair strands. The processes for carrying out such hair treatment are conventionally termed "highlighting" or "low lighting" of hair, or "tinting" or "frosting". The general technique enables individualized treatment of one's hair in a manner believed complimentary to the individual. In accordance with one known technique for such treatment of hair, selected strands of hair are separated from the remaining hair and, while supported on a sheet of tinfoil-like material held in the beautician's hand, are treated with a hair treating substance such as a tinting or bleaching liquid. After applying the liquid substance to the segregated strands of hair, the foil sheet is wrapped around the treated hair strands in a manner to isolate them from adjacent strands of hair while the applied substance effects the desired color change. The foil is thereafter removed and disposed of.

Another prior technique for highlighting or low lighting strands of hair is to employ a liquid impermeable head cover or cap having a plurality of holes formed therein through which strands of hair may be withdrawn so as to segregate the withdrawn strands and enable application of a hair treating substance thereto without application of the hair treating substance to adjacent hair strands. This technique also requires wrapping of the treated hair strands, generally by tinfoil wraps or the like, until the hair has undergone the desired color change after which the tinfoil and cap are removed to facilitate final hair treatment and setting.

In addition to the aforementioned techniques for treating hair, a number of other devices have been developed for use in highlighting or low lighting hair. For the most part, the known devices enable isolation of selected strands of hair, application of a hair treating substance thereto, and wrapping of the treated strands so as to maintain them isolated from remaining hair strands during the treating process. See, for example, U.S. Pat. Nos. 3,871,388, 4,144,897, 4,196,741 and 4,224,954. While the devices disclosed in these prior patents have been found generally acceptable for their intended purposes, they generally require a substantial number of manual mainpulative steps during use which is both time consuming and inefficient. A further significant drawback with the known devices for highlighting or low lighting hair is that they are relatively complex in construction and therefore expensive to manufacture.

SUMMARY OF INVENTION

One of the primary objects of the present invention is to provide a novel device for use in treating hair, as in highlighting or low lighting of hair, which is relatively simple to use, economical to manufacture and highly efficient for its intended purpose.

A more particular object of the present invention is to provide a novel device for use in treating hair, as in highlighting or low lighting of selected strands of hair, which employs a pliable sheet of liquid impermeable material adapted to be placed in underlying relation to selected strands of hair during application of a hair treating substance thereto, the sheet in one embodiment being of sufficient length to enable folding over upon itself with the selected hair strands between the juxtaposed sheet layers. The pliable sheet has a plurality of domains of positive and negative magnetic polarity defined throughout which facilitate magnetic attraction of the folded sheet layers to each other to firmly retain them in liquid sealed relation peripherally of the strands of hair so as to prevent the hair treating substance from leaking or seeping outwardly from the juxtaposed sheet layers. In another embodiment, a separate pliable sheet of similar material may be placed in overlying relation to the sheet underlying the hair strands being treated so as to isolate the hair strands. In either embodiment, the overlying sheets may be readily separated to facilitate observation of the treated hair strands for application of a further hair treating substance after which the sheets may again be readily secured to each other or retained for subsequent reuse.

A feature of the hair treating device in accordance with the present invention lies in the utilization of a liquid impermeable flexible or pliable material having a plurality of generally uniformly distributed domains of alternating positive and negative polarity magnetic fields formed throughout and extending outwardly of its surface which facilitate substantially full surface releasable magnetic attraction between layers of the material when placed in juxtaposed relation with selected strands of treated hair interposed therebetween, the sheet layers being of sufficient width to extend laterally outwardly from the strands of hair to form a liquid barrier peripherally of the strands of hair during treatment.

A feature of one embodiment of the hair treating device in accordance with the present invention lies in the provision of a strip or pad of liquid absorbing material adjacent at least one end of the liquid impermeable sheet so that any hair treating substance tending to seep from between the juxtaposed layers of pliable sheet material is absorbed by the liquid absorbing pad and is thereby prevented from contact with the user's skin.

Further objects and advantages of the present invention, together with the organization and manner of operation thereof, will become apparent from the following detailed description of the invention when taken in conjunction with the accompanying drawing wherein like reference numerals designate like elements throughout the several views.

DESCRIPTION OF PREFERRED EMBODIMENTS

Figures 1, 2, 3, 4, 5:
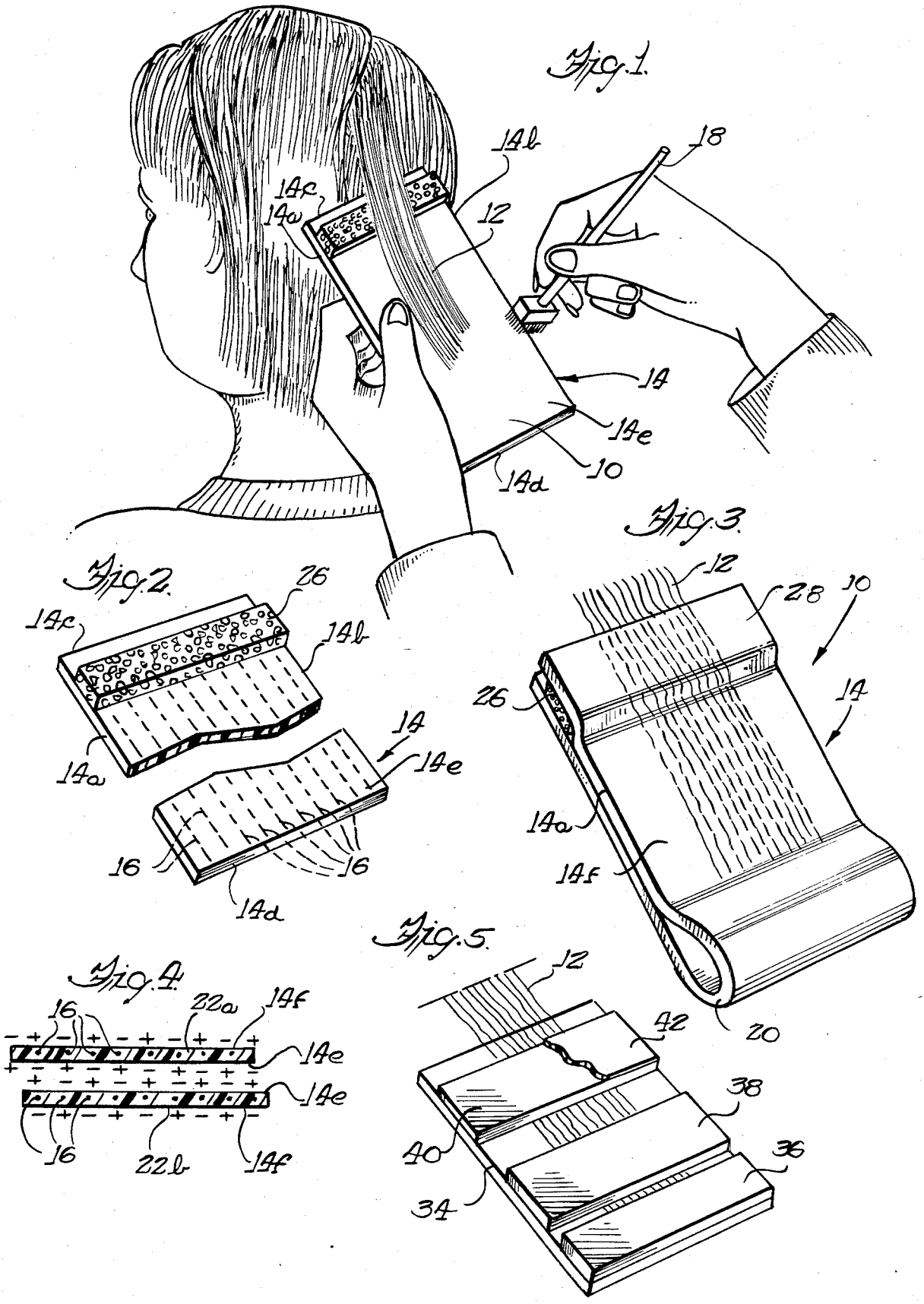
FIG. 1 is a perspective view illustrating use of a hair treating device in accordance with the present invention.
FIG. 2 is a foreshortened perspective view of the hair treating device of FIG. 1.
FIG. 3 is a perspective view illustrating the hair treating device of FIG. 1, but folded to isolate the treated strands of hair after application of a hair treating substance.
FIG. 4 is a transverse sectional view of the folded hair treating device of FIG. 3, but showing the overlying sheets in spaced relation to illustrate the magnetic attraction therebetween.
FIG. 5 is a perspective view illustrating an alternative embodiment of a hair treating device in accordance with the invention.

Referring now to the drawing and in particular to FIGS. 1–3, one embodiment of a hair treating device constructed in accordance with the present invention is indicated generally at 10. The hair treating device 10 is illustrated, by way of example, as being used in the treating of selected strands of hair 12 which have been segregated from the remaining hair of an individual for purpose of treating the selected hair strands. As used herein, the treating or treatment of hair refers to the general process of applying a hair treating substance to one's hair or selected strands of hair in a manner to obtain desired tinting, alternativley termed highlighting or low lighting, or hair or to achieve another hair processing result such as bleaching which may be defined as a form of tinting.

The hair treating device 10 illustrated in FIGS. 1–3 includes a pliable or flexible liquid impermeable sheet, indicated generally at 14, which is of generally rectangular sheet form or configuration and has a longitudinal length substantially greater than its transverse width, although other configurations may be selected. The pliable sheet 14 has laterally opposite longitudinal edges 14*a* and 14*b* which terminate at transverse end edges 14*c* and 14*d* termed the lower edges, respectively, of the pliable sheet. For purposes of description, the surface 14*e* may be termed the upper outer surface of the pliable sheet, while the opposite surface, indicated at 14*f* in FIG. 3, may be termed the outer lower surface of the pliable sheet.

Conventionally, when tinting hair, a selected number of hair strands, such as indicated at 12, are separated from the remaining hair strands and are treated with a hair substance after which the treated hair strands are isolated from the remaining hair strands for a period of time sufficient to enable the hair treating substance to effect the desired reaction with the selected hair strands. To facilitate support of the selected hair strands during application of a hair treating substance thereto, the pliable sheet 14 has a lateral width sufficient to extend laterally outwardly from the opposite sides of the selected hair strands 12 and, in the embodiment illustrated in FIGS. 1–3, has a longitudinal length equal to approximately twice the length of the strands to be treated.

In accordance with one feature of the invention, the pliable sheet 14 is made of a pliable or flexible plastic material and has a plurality of domains of alternating positive and negative polarity disposed generally uniformly throughout the pliable sheet so that zones or regions of alternating magnetic polarity extend outwardly from the surfaces 14*e* and 14*f*. One example of such a material is commercially available from 3M Corporation its tradename PLASTIFORM Brand magnetic strip or sheetng which is defined as a flexible permanent magnet material. To this end, the pliable sheet 14 may be made of a cured or vulcanized nitrate rubber binder having a plurality of barium ferrite crystals contained or impregnated intermediate the outer surfaces 14*e* and 14*f* so that the barium ferrite particles are positioned in generally longitudinal rows, such as indicated by the dash lines 16 in FIG. 2. The barium ferrite crystals are spaced in their respective rows and have predetermined orientation so that upon passing the ferrite particle impregnated pliable cured binder material through a suitable magnetizing medium, discrete longitudinal rows of magnetized particles are established along the length of the pliable sheet 14 which define longitudinal rows or domains of alternating magnetic polarity, when considered transversely of the sheet. That is, the ferrite particles of each longitudinal row have the same magnetic polarity, but are of opposite polarity to the ferrite particles in the next adjacent row. The domains of alternating magnetic polarity are schematically illustrated in FIG. 4 shows juxtaposed layers of the pliable sheet 14 in transverse cross section so as to illustrate the ferrite particles or crystals 16 and their associated magnetic polarities established as external zones or domains of alternating polarity. The north and south pole polarities are represented by + and −, respectively. It has been found that employing a pliable sheet 14 with a thickness of approximately 0.020″ to 0.060″ and a transverse width of approximately three inches provides sufficient flexibility to enable folding of the material, to be described hereinafter, while maintaining sufficient stability for handling purposes.

In accordance with one technique for using the hair treating device 10 as thus far described, the pliable sheet 14 is positioned to underlie the selected hair strands 12 to be treated, as illustrated in FIG. 1, such that the strands lie generally longitudinally along the pliable sheet on the surface 14*e* thereof. A suitable hair treating substance, such as a tinting or bleaching solution, may then be applied to the separated strands as by a brush 18 or the like. After applying the hair treating substance to the separated hair strands 12, the lower end of the pliable sheet 14 is folded upon itself to a position as illustrated in FIG. 3. Depending upon the thickness of the pliable sheet 14, it may be preferable to fold the sheet so as to establish a curved loop fold, as illustrated at 20 in FIG. 3, rather than being folded into a tight transverse crease which could lead to transverse fracture at the fold line. The pliable sheet 14 is folded such that the lower free end portion thereof overlies the upper end in juxtaposed relation to the portion of the sheet underlying the separated hair strands 12. The lower folded end of the sheet is brought into engagement with the exposed surface 14*e* underlying the hair strands such that the lateral edge surfaces of the folded lower portion engage the exposed lateral edge surfaces of the upper portion outwardly from opposite sides of the hair strands.

As the lower portion of the pliable sheet 14 is folded upwardly to overlie the upper portion of the sheet, the folded portion will tend to be slightly laterally displaced relative to the upper portion when brought onto engagement with the upper portion. This is best illustrated in FIG. 4 which shows a lateral shifting of the folded portion 22*a* of the pliable sheet such that the magnetic zones or domains of alternating polarity which extend longitudinally of the folded portion overlie and are attracted to opposite polarity domains on the underlying sheet portion 22*b*. In this manner, the magnetic attraction between opposite magnetic polarity domains will firmly hold the juxtaposed pliable sheet portions in relatively fixed relation to each other with the treated strands of hair 12 between the superimposed portions of the sheet. The magnetic attraction between the domains of opposite magnetic polarity is sufficient to facilitate substantially full surface releasable magnetic attraction between the sheet layers when placed in juxtaposed relation with selected strands of hair interposed therebetween and thereby maintain the contacting lateral edge surfaces of the folded pliable sheet 14 in liquid sealed relation so as to prevent seepage of hair treating solution outwardly from the folded sheet portions, thus isolating the treated hair strands.

If desired, liquid absorbing means in the form of a liquid absorbing cellular sponge-like member 26 may be suitably affixed to surface 14*e* of the pliable sheet 14 adjacent one end thereof and in transverse relation thereto. Upon folding of the lower portion of the pliable sheet upon itself, the free end of the folded portion, indicated at 28 in FIG. 3, is positioned to overlie the sponge member 26. In this manner, any hair treating substance tending to seep outwardly from between the juxtaposed surfaces of the folded sheet will be absorbed by the liquid absorbing member 26. If the full lengths of the separated hair strands 12 are to be treated, the sheet 14 is preferably initially positioned so that the sponge member 26 is closely adjacent the scalp area at the roots of the separated hair strands.

While the embodiment of the hair treating device 10 thus far described employs a single integral sheet or pliable liquid impermeable material 14, the hair treating device may employ separate sheets of pliable material 14 having discrete domains of alternating magnetic polarity defined throughout the respective sheets. FIG. 5 illustrates an alternative embodiment wherein a first generally rectangular pliable liquid impermeable sheet 34 having characteristics identical to the aforedescribed pliable sheet 14 is of sufficient size to underlie a desired length of selected hair strands 12 and extend laterally outwardly from opposite sides of the separated hair strands. One or more separate pliable sheets of similar material, such as indicated at 36, 38 and 40, may be placed in overlying juxtaposed position on the lower sheet 34 so as to facilitate isolation of selected portions of the hair strands. The sheets 36, 38 and 40 may be of similar or different sizes and are similarly characterized as having domains of alternating magnetic polarity throughout substantially their full exposed surfaces so as to effect magnetic attraction with and retention by the lower flexible sheet 34 in generally liquid tight relation therewith similar to the folded integral pliable sheet 14. It will be understood that a single separate pliable sheet may be employed to fully overlie the selected hair strands 12 and exposed lateral edge portions of bottom sheet 34 after treating the separated hair strands, while the use of separate smaller size sheets 36, 38 and 40 may be desirable to transversely overlie selected lengths or areas of the separated hair strands when treated at spaced intervals along their lengths. Transverse liquid absorbing members, such as the aforedescribed sponge-like member 26, may be selectively affixed on the underlying sheet 34, if desired.

The surface 14*f* of the pliable sheet 14 or the outer exposed surfaces of the pliable sheets 34, 36, 38 and 40 may have a lamination layer applied thereon; such as indicated at 42 in FIG. 5, which is made of a pliable material suitable to substantially nullify the magnetic field flux that would otherwise act outwardly of the surface on which the lamination is applied. In this manner, the lamination will prevent magnetic attraction of the corresponding underlying pliable sheet, such as 40, to other adjacent sheets having magnetic characteristics similar to sheet 14.

It has been found that the embodiments of the hair treating device illustrated in FIGS. 1–5 provide very efficient means for isolating selected strands of hair both during and after application of a hair treating solution to the hair strands, while enabling easy manipulation in carrying out the described techniques. The pliable sheet 14 is resistant to normal temperatures which might be employed to accelerate drying of the treated hair strands while isolated between layers of the pliable sheet 14 or between separate magnetically affixed sheets.

A major advantage of the hair treating device in accordance with the present invention lies in its utility for reuse without losing its magnetic properties. This is particularly important in hair styling where the hair stylist frequently applies a bleach or tint to selected strands of hair and allows them to set for a predetermined period of time after which they are rinsed and a further toner or chemical liquid is applied to these same hair strands. With the hair treating device 10, the hair stylist or home operator may readily separate the overlying portions of the pliable sheet to expose the treated hair strands for rinsing and subsequent application of a toner or other liquid treating substance, followed by reapplication of the liquid impervious pliable sheet to again isolate the treated hair strands until the desired effect is obtained.

While preferred embodiments of the invention have been illustrated and described, it will be understood that changes and modifications may be made therein without departing from the invention in its broader aspects. Various features of the invention are defined in the following claims.

What is claimed is:

1. A hair treating device comprising a first pliable liquid impermeable sheet adapted to be placed in underlying relation to selected strands of hair during application of a hair treating substance to the selected strands, said first sheet being of sufficient lateral width to extend laterally outwardly from opposite sides of the selected strands, and a second pliable liquid impermeable sheet of substantially similar lateral width as said first sheet and of sufficient length to substantially overlie said first sheet in juxtaposed generally full surface contact when placed thereagainst with said selected strands between said first and second sheets, said first and second sheets having discrete domains of alternating magnetic polarity defined throughout substantially their full surface areas operative to releasably maintain said sheets in selectively placed juxtaposed relation through magnetic attraction therebetween and establish a liquid seal about substantially the full periphery of said selected strands after application of said treating materials.

2. A hair treating device a defined in claim 1 wherein said first and second sheets are formed integral and are of sufficient pliability to enable transverse folding into said juxtaposed relation.

3. A hair treating device as defined in claim 1 including liquid absorbing means mounted on a selected one of said first and second sheets in a position to absorb liquid material seeping from between said sheets in a direction traversing said liquid absorbing means.

4. A hair treating device as defined in claim 3 wherein said liquid absorbing means comprises a liquid absorbent member.

5. A hair treating device as defined in claim 1 wherein said sheets are made of a polymer binder having ferromagnetic crystals imbedded therein in predetermined crystalline orientation so as to define parallel rows of discrete ferromagnetic particles within said sheets, said ferromagnetic crystals being magnetized so as to define said discrete domains of alternating polarity throughout said sheets.

6. A hair treating device as defined in claim 5 wherein said discrete domains of alternating magnetic polarity are defined by longitudinal rows of said ferromagnetic particles magnetized so that alternate magnetic polarity domains are established transversely across said sheets.

7. A hair treating device as defined in claim 5 wherein said ferromagnetic particles comprise barium ferrite crystals.

* * * * *

UNITED STATES PATENT AND TRADEMARK OFFICE

CERTIFICATE OF CORRECTION

PATENT NO. : 4,552,159

DATED : November 12, 1985

INVENTOR(S) : Vittorio E. Fabbri and Jackie D. Bell

It is certified that error appears in the above-identified patent and that said Letters Patent is hereby corrected as shown below:

Column 1, line 55 "mainpulative" should be --manipulative--.

Column 3, line 14 "purpose" should be --purposes--.

Column 3, line 18, "alternativley" should be --alternatively--.

Column 3, line 19 "or" (first occurrence) should be -- of --.

Column 3, line 39 "hair substance" should be --hair treating substance--.

Column 3, lines 58-59 "Corporation its" should be --Corporation under its--.

Column 3, line 60 "sheetng" should be --sheeting--.

Column 5, line 23 "or" should be --of--.

Column 6, line 10 "device" should be --device 10--.

Column 6, line 52 "a defined" should be --as defined--.

Column 6, lines 62-63 "absorbent" should be --absorbant--.

Signed and Sealed this

Ninth Day of December, 1986

*Attest:*

DONALD J. QUIGG

*Attesting Officer*

*Commissioner of Patents and Trademarks*